US006171124B1

(12) United States Patent
Kojima

(10) Patent No.: US 6,171,124 B1
(45) Date of Patent: Jan. 9, 2001

(54) CONNECTOR

(75) Inventor: Eiji Kojima, Yokkaichi (JP)

(73) Assignee: Sumitomo Wiring Systems, Ltd. (JP)

( * ) Notice: Under 35 U.S.C. 154(b), the term of this patent shall be extended for 0 days.

(21) Appl. No.: 09/207,416

(22) Filed: Dec. 8, 1998

(30) Foreign Application Priority Data

Dec. 12, 1997 (JP) ..... 9-343002

(51) Int. Cl.[7] ..... H01R 29/00
(52) U.S. Cl. ..... 439/188; 439/862; 200/51.1
(58) Field of Search ..... 439/188, 862; 200/51.1

(56) References Cited

U.S. PATENT DOCUMENTS 5,263,872 11/1993 Marpoe, Jr. et al. ..... 200/51.1

FOREIGN PATENT DOCUMENTS 295 09 313 8/1995 (DE) .
389 779 10/1990 (EP) .
616 397 9/1994 (EP) .
758 806 2/1997 (EP) .
825 685 2/1998 (EP) .
9-147988 6/1997 (JP) .

*Primary Examiner*—Neil Abrams
(74) *Attorney, Agent, or Firm*—Banner & Witcoff, Ltd.

(57) ABSTRACT

A chamber capable of housing a short-circuiting terminal is provided in a female housing. An opening is formed on the front of the chamber, the base face thereof having a recessed opening. A relatively thick short-circuit canceling member of a male housing is inserted from the front opening into the chamber, whereupon resilient contact members of the short-circuiting terminal bend downwards. The free ends of the terminal enter the recessed opening. While the short-circuiting terminal is provided with a greater bending stroke, the chamber can be kept low in height due to the recessed opening. Accordingly, the male housing can be kept small, and thus miniaturized.

2 Claims, 3 Drawing Sheets

CONNECTOR

TECHNICAL FIELD

The present invention relates to an improvement of an electrical connector provided with short-circuiting terminal.

BACKGROUND OF THE INVENTION

One example of this type of connector is used in the circuit of an air bag of a motor vehicle. As shown in FIG. 6(A), this type of connector comprises a plurality of female terminal fittings 2 housed within a female housing 1, and a short-circuiting terminal 3 provided within a housing chamber 4 in order to short-circuit the female terminal fittings 2. A corresponding male housing 5 comprises tab-shaped male terminal fittings 6 which fit together with the female terminal fittings 2, and a short-circuit cancelling member 7 capable of being inserted between the female terminal fittings 2 and the short-circuiting terminal 3. When the two housings 1 and 5 are in a separated state, the female terminal fittings 2 are short-circuited by the short-circuiting terminal 3. When the two housings 1 and 5 are fitted together, the male and female terminal fittings 2 and 6 make contact. As shown in FIG. 6(B), the short-circuiting cancelling member 7 is inserted between the short-circuiting terminal 3 and the female terminal fittings 2, causing the short-circuiting terminal 3 to bend, thereby cancelling the short-circuiting of the female terminal fittings 2. Such a general arrangement is well known.

However, the short-circuiting cancelling member 7 protrudes from the fitting face of the male housing 5 and, consequently, there is the danger that it may come into contact with foreign objects and thereby become bent or otherwise damaged. In order to prevent this from happening, the cancelling member 7 may be made thicker in order to increase its strength. In this case, however, the short-circuiting terminal 3 would be required to bend to a correspondingly greater extent. Consequently, the height of the housing chamber 4 would have to be increased in order to maintain a space to allow the bending of the short-circuiting terminal 3 and thus a larger housing would be required. This would result in an inevitable increase in the amount of material used, and thus cost.

The present invention has been developed after taking the above problem into consideration, and aims to present a connector in which the necessary bending stroke of the short-circuit terminal can be provided without increasing the size of the housing.

SUMMARY OF THE INVENTION

According to one aspect of the invention there is provided an electrical connector comprising a housing having two independent terminal fittings therein, a chamber adjacent said fittings, and a short-circuit terminal in said chamber, said short-circuit terminal having a resilient cantilever arm means biased into electrical engagement with said terminal fittings to provide a short-circuit therebetween, a free end of said arm means being turned away from said terminal fittings and being movable by an insertion member of a mating connector against the resilient bias to break said electrical engagement, characterised in that the floor of said chamber includes a recess to accommodate said free end when moved against said bias.

According to another aspect of the invention there is provided an electrical connector comprising a housing having two independent terminal fittings therein, and a short circuit terminal biased into electrical engagement with said terminal fittings to provide a short circuit therebetween, wherein said short circuit terminal is resilient and 'C' shaped, one arm means of said short circuit terminal contacting said terminal fitting, and the other arm means comprising a reaction member located with respect to said housing, a free end of said one arm means being turned away from said terminal fittings and being movable by an insertion member of a mating connector against the resilient bias to break said electrical engagement characterised in that said housing is adapted to permit said free end to cross said other arm means when moved against said bias. Such a connector allows the short circuit terminal to bend further than normal, thus allowing a thicker cancelling member whilst not increasing the overall size of the connector housing.

Preferably the recess provided in the short circuit chamber opens to the mating face of the connector; such a recess is relatively easy to mould, without the use of inserts.

DESCRIPTION OF THE DRAWINGS

Other features of the invention will be apparent from the following description of a preferred embodiment shown by way of example only in the accompanying drawings, in which.

DESCRIPTION OF PREFERRED EMBODIMENTS

An embodiment of the present invention is explained below with the aid of FIGS. 1 to 5.

Figure 1:
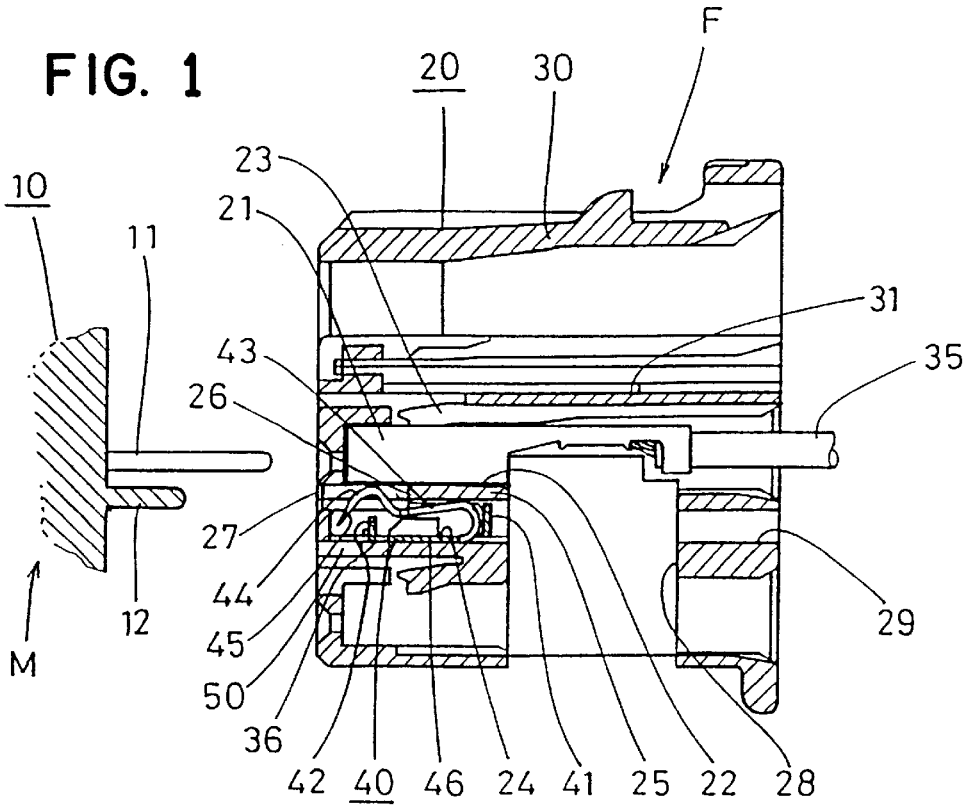
FIG. 1 is a cross-sectional view of an embodiment of the present invention showing two connectors in a state prior to being fitted together.

The symbol F in FIG. 1 refers to a female connector provided with a female housing 20, a plurality of female terminal fittings 21 housed within this female housing 20, and a short-circuiting terminal 40 which short-circuits specified female terminal fittings 21. The female connector F fits together with a male connector M shown partially, to the left in FIG. 1. An explanation of the male connector M follows later.

The joining faces of both the male and female connectors M and F are hereinafter referred to as anterior faces.

Cavities 22 are formed within the female housing 20, these cavities 22 housing female terminal fittings 21 to which the ends of electric wires 35 have been attached by crimping. Each of these cavities 22 are formed so as to be divided into upper and lower sections. A female terminal fitting 21 is inserted into each cavity 22 from the posterior, the female terminal fitting 21 being retained therein by a lance 23 provided on the upper face of each cavity 22. The female terminal fittings 21 are housed in two adjoining chambers of the upper section of the cavity 22, and are short-circuited by the short-circuiting terminal 40.

The short-circuiting terminal 40 is provided with a base plate 46, a wall member 41 extending along the side edge and posterior edge of this base plate 46, and a pair of resilient contact members 43 being provided in the left and right, these resilient contact members 43 being cantilevered and bent over from the posterior edge of the base plate 46 in an anterior direction. The anterior ends of the resilient contact members 43 are peaked, as illustrated, the peaks forming contacts 44. The anterior ends 45 of the resilient contact members 43 protrude diagonally downwards in an anterior direction. A regulating member 42 protrudes upwards from the anterior edge of the base plate 46, this regulating member 42 making contact with the inner face of the contacts 44 and regulating the degree of bending of the resilient contact members 43.

A short-circuiting terminal housing chamber 24 for housing the short-circuiting terminal 40 is provided below the two chambers of the female terminal fittings 21 to be short-circuited. The chamber 24 has the same width as the two chambers of the cavity 22, and extends from the anterior end of the female housing 20 to approximately the centre thereof. The anterior end of the ceiling portion of the chamber 24 is open so as to connect to the two chambers of the cavity 22, and the posterior end thereof forms a ceiling face 25. In its natural state, this ceiling face 25 is lower than the height of the contacts 44 and the anterior end thereof forms a stopping member 26 which engages the contacts 44. The anterior face of the short-circuiting terminal housing chamber 24 has an opening 27.

The short-circuiting terminal 40 is attached in the chamber 24 in the following manner. At the posterior end of the chamber 24, a retainer attachment hole 28 connects with the cavities 22 and the chamber 24 and opens into the lower face of the female housing 20. An operating hole is formed at the posterior of the retainer attachment hole 28, this operating hole 29 having the same height as the short-circuiting terminal housing chamber 24 and being open on the posterior face of the female housing 20. A supporting member 32 can be inserted into the retainer attachment hole 28, this supporting member 32 being provided with a supporting chamber 31 which houses the short-circuiting terminal 40.

Figure 2:
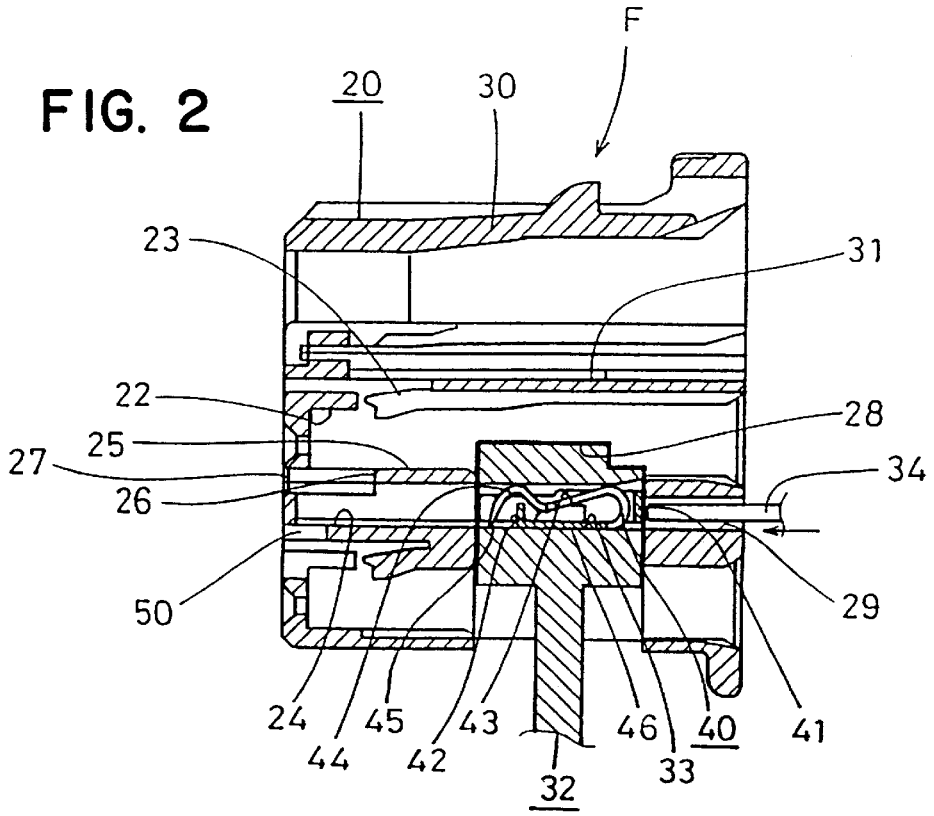
FIG. 2 is a cross-sectional view illustrating the housing operation of a short-circuiting terminal.
Figure 3:
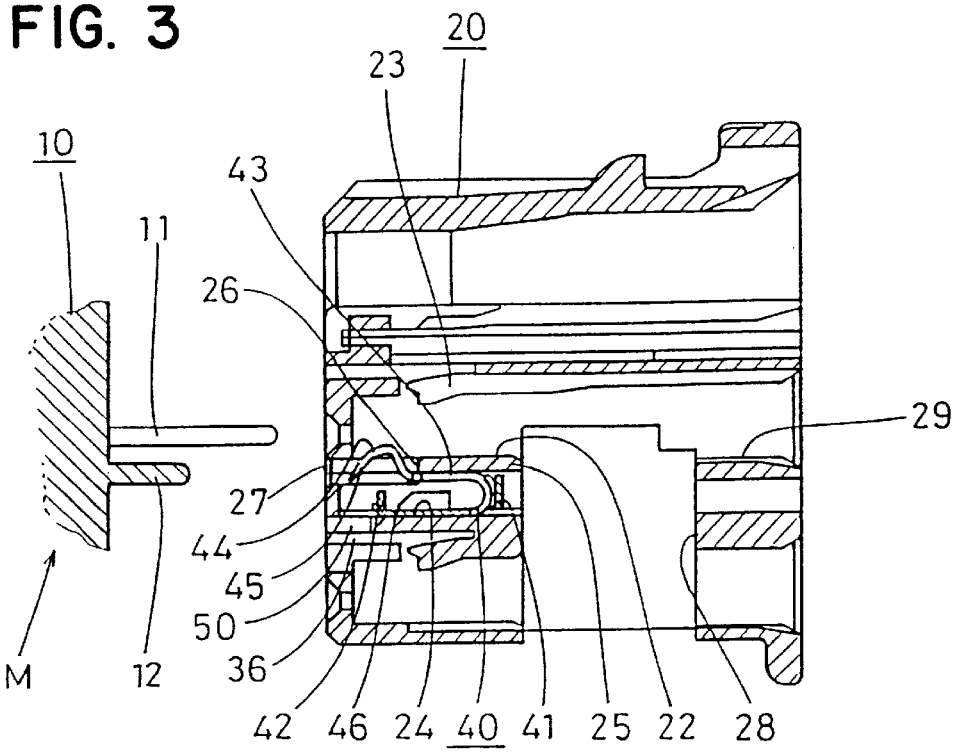
FIG. 3 is a cross-sectional view showing the short-circuiting terminal in a housed state.

As shown in FIG. 2, after the supporting member 32, which houses the short-circuiting terminal 40, has been inserted into the retainer attachment hole 28, a pushing pin 34 is inserted into the operating hole 29 from the posterior thereof and makes contact with a wall member 41 located at the posterior end of the short-circuiting terminal 40, and the short-circuiting terminal 40 is pushed in, in the direction of the arrow in FIG. 2. Thereupon, the resilient contact members 43 pass in a bent state under the ceiling face 25 and move into the short-circuiting terminal housing chamber 24. The contacts 44 reach the stopping member 26, whereupon the resilient contact members 43 return resiliently to their original state and are engaged by the stopping member 26, being maintained in the correct position as shown in FIG. 3. As this juncture, the contacts 44 of the resilient contact members 43 protrude into the cavities 22 above, making resilient contact with the base faces of the corresponding female terminal fittings 21. After the short-circuiting terminal 40 has been housed, the supporting member 32 and the pushing pin 34 are removed from the female housing 20, and a retainer (not shown) can be attached to the retainer attachment hole 28 to doubly stop the female terminal fittings 21.

The male connector M is provided with a male housing 10, a plurality of male terminal fittings 11 protruding from the male housing 10 and capable of being inserted in the female terminal fittings 21, and a protruding short-circuit cancelling member 12. This cancelling member 12 is inserted into the opening 27 and between the female terminal fittings 21 and the short-circuiting terminal 40 when these are making contact, and thereby cancelling their short-circuit. This short-circuit cancelling member 12 is thicker than conventional short-circuit cancelling members and has greater strength.

A recess opening 50 is formed on the base face of the chamber 24, this recess 50 being formed from the anterior end portion of the chamber 24 to a position slightly anterior of the regulating member 42 when the latter is in a housed state within the chamber 24. The recessed opening 50 is open to the anterior face of the female housing 20 and to a lance releasing space 36 below the chamber 24. In the case where the resilient contact members 43 have bent downwards, the anterior ends 45 of the resilient contact members 43 can move into this recessed opening 50.

A housing chamber 31 is formed on the upper portion of the female housing 20, a half-fitted state detecting terminal (not shown) being housed therein, this half-fitted state detecting terminal detecting a half-fitted state of the housings 10 and 20 by inclining a locking arm 30.

With the configuration as described above, the operation of the present embodiment is explained herein below.

First, as has been described above, the supporting member 32 and the pushing pin 34 are used to house the short-circuiting terminal 40 within the short-circuiting terminal housing chamber 24. Next, the female terminal fittings 21 are inserted from the posterior into the cavities 22 and, when they have reached the correct position, are stopped by lances 23. As shown in FIG. 1, the female terminal fittings 21, which are being short-circuited by the short-circuiting terminal 40, push down the resilient contact members 43. Then, the retainer is attached to the retainer attachment hole 28, doubly stopping the female terminal fittings 21.

Figure 4:
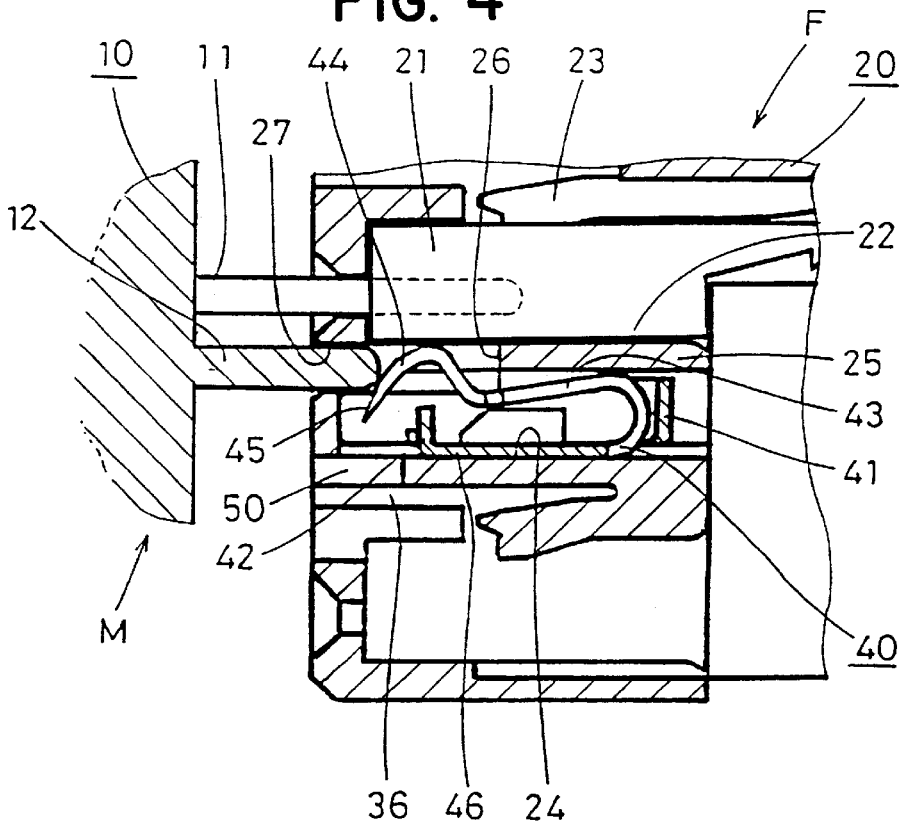
FIG. 4 is a partially enlarged cross-sectional view showing the two connectors in the process of being fitted together.

The female connector F is next fitted to the corresponding male contact M. By so doing, as shown in FIG. 4, the male terminal fittings 11 are inserted from the anterior into the corresponding cavities 22 of the female housing 20, the short-circuit cancelling member 12 making contact with the female terminal fittings 21 before making contact with the short-circuiting terminal 40; terminal fittings 11 and 21 are in a conductive state.

Figure 5:
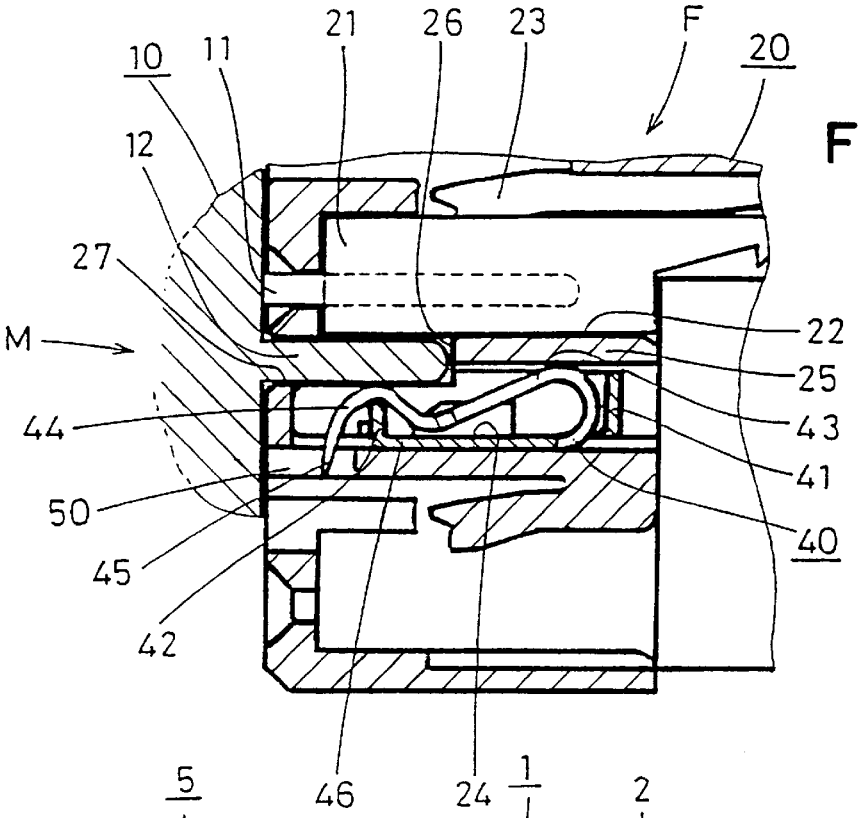
FIG. 5 is a partial expanded enlarged cross-sectional view showing the two connectors in a short-circuit cancelling state.
Figure 6A:
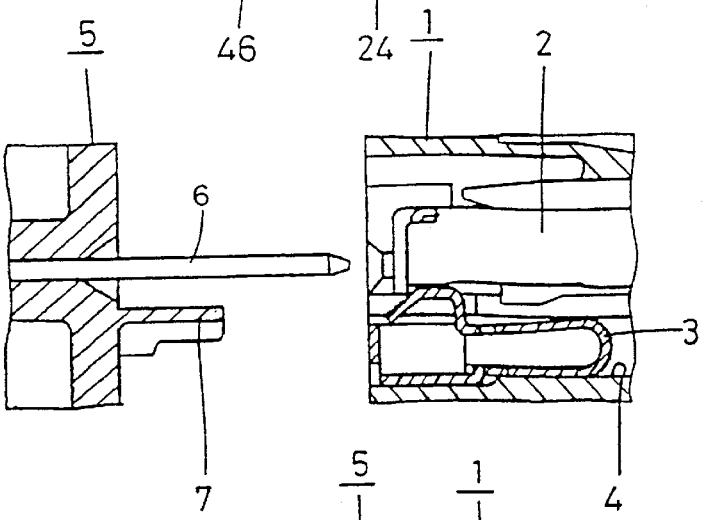
FIG. 6A PRIOR ART
FIGS. 6A and 6B are cross-sectional views of a prior art connector.
Figure 6B:
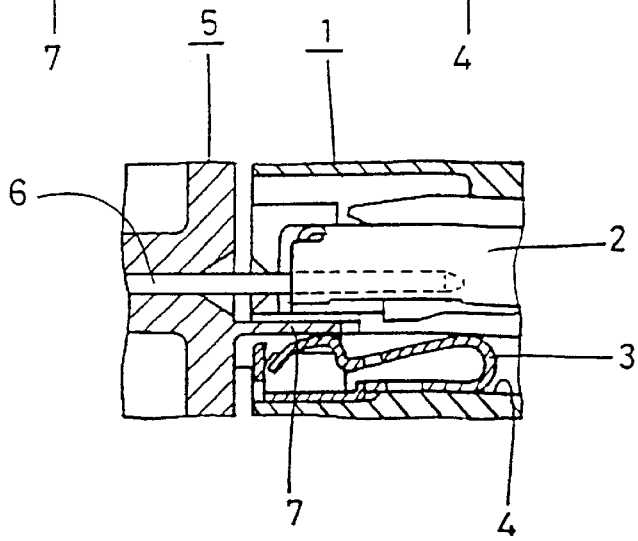
FIG. 6B PRIOR ART

As shown in FIG. 5, as the fitting operation continues the male terminal fittings 11 are inserted into the interior, and the short-circuit cancelling member 12 passes through the opening 27 and, as it is inserted more deeply into the interior of the short-circuiting terminal housing chamber, makes contact with the anterior ends 45 of the resilient contact members 43 of the short-circuiting terminal 40, causing the resilient contact members 43 to bend downwards, thereby separating the female terminal fittings 21 and the short-circuiting terminal 40. By this means, the short-circuiting state of the female terminal fittings 21 is cancelled.

The short-circuit cancelling member 12 described above is thick. As a result, the resilient contact members 43 of the short-circuiting terminal 40 have to bend downwards extensively. However, at this juncture, as the anterior ends 45 bend, they protrude downwards to the lower face of the recessed opening 50, and the resilient contact members 43 are therefore not prevented from bending. That is, the anterior ends 45 of the short-circuiting terminal 40 are permitted to bend by escaping into the recessed opening 50. As a result, the bending space provided by the recessed opening 50 facilitates the bending of the resilient contact members 43.

According to the embodiment described above, the recessed opening 50 is provided in the base face of the short-circuiting terminal housing chamber 24 and allows the anterior ends 45 of the resilient contact members 43 of the short-circuiting terminal 40 to enter therein. Consequently, even though the short-circuiting terminal 40 is provided with a greater bending stroke, the short-circuiting terminal housing chamber 24 can be formed with a low ceiling and the female housing 20 can be kept small, and thus miniaturised to that extent.

The present invention is not limited to the embodiments described above with the aid of figures. For example, the possibilities described below also lie within the technical range of the present invention. In addition, the present invention may be embodied in various other ways without deviating from the scope thereof.

In the present embodiment, an example of a connector was used in which a short-circuiting terminal is inserted using a supporting member. However, the present invention is also applicable to a connector in which the short-circuiting terminal is inserted in another way.

What is claimed is:

1. An electrical connector comprising a housing having two independent terminal fittings therein, a chamber adjacent said fittings, and a short-circuit terminal in said chamber, said short-circuit terminal having a resilient cantilever arm biased into electrical engagement with said terminal fittings to provide a short-circuit therebetween and a regulating member which extends toward the arm, a free end of said arm being turned away from said terminal fittings and being movable by an insertion member of a mating connector against the resilient bias to break said electrical engagement, wherein the floor of said chamber includes a recess to accommodate said free end when moved against said bias, and wherein a remote end of the regulating member permits the free end of the arm to move into the recess when engaged by the insertion member but is adapted to abut the arm to prevent excessive bending of the arm.

2. A connector according to claim 1 wherein said recess opens into the mating face of said housing.

* * * * *